US010378755B1

(12) United States Patent
Caradine

(10) Patent No.: US 10,378,755 B1
(45) Date of Patent: Aug. 13, 2019

(54) SEGMENTED WATERTUBE BOILER SYSTEM

(71) Applicant: Jimmie P. Caradine, Commerce, TX (US)

(72) Inventor: Jimmie P. Caradine, Commerce, TX (US)

( * ) Notice: Subject to any disclaimer, the term of this patent is extended or adjusted under 35 U.S.C. 154(b) by 0 days.

(21) Appl. No.: 15/832,034

(22) Filed: Dec. 5, 2017

Related U.S. Application Data

(60) Provisional application No. 62/429,933, filed on Dec. 5, 2016.

(51) Int. Cl.

| | |
|---|---|
| ***F22B 33/00*** | (2006.01) |
| ***F22B 33/04*** | (2006.01) |
| ***F22B 21/00*** | (2006.01) |
| ***F22B 37/10*** | (2006.01) |
| *F22B 9/18* | (2006.01) |
| *F22B 37/12* | (2006.01) |

(52) U.S. Cl.
CPC ..... *F22B 33/04* (2013.01); *F22B 21/002* (2013.01); *F22B 37/104* (2013.01); *F22B 9/18* (2013.01); *F22B 37/12* (2013.01)

(58) Field of Classification Search
CPC ..... F22B 17/10; F22B 17/12; F22B 17/18; F22B 21/06; F22B 21/065; F22B 21/083
See application file for complete search history.

(56) References Cited

U.S. PATENT DOCUMENTS

| | | | | | |
|---|---|---|---|---|---|
| 650,694 | A * | 5/1900 | Sheppard | F24H 1/32 | 122/231 |
| 1,871,500 | A * | 8/1932 | Daniels | F22B 17/10 | 122/303 |
| 1,889,412 | A * | 11/1932 | Lukomske | F24H 1/32 | 122/210 |
| 2,273,453 | A * | 2/1942 | Vandenberg | F23M 3/02 | 122/225 R |
| 3,215,125 | A * | 11/1965 | Mueller | F24H 1/32 | 122/225 R |
| 3,382,848 | A * | 5/1968 | Northcote | F22B 21/085 | 122/235.11 |
| 3,796,194 | A * | 3/1974 | Peterson | F22B 17/12 | 122/225 B |
| 3,839,993 | A * | 10/1974 | Peterson | F22B 13/00 | 122/231 |
| 3,908,603 | A * | 9/1975 | Schiffelers | F24H 1/38 | 122/209.1 |
| 4,294,199 | A * | 10/1981 | Darling | F22B 21/083 | 122/248 |
| 4,879,959 | A * | 11/1989 | Korenberg | F22B 7/20 | 110/264 |

* cited by examiner

*Primary Examiner* — Nathaniel Herzfeld
(74) *Attorney, Agent, or Firm* — Eldredge Law Firm, LLC; Richard Eldredge; Beth Felix

(57) ABSTRACT

A segmented watertube boiler system allows for rapidly expanding the capacity of a boiler. The system joins boiler segments to form a boiler. The segments have portions of the boiler so that the storage capacity for water and heat are increased with the number of segments uses. Any openings in the segments on the ends are capped off and heat and water sources are attached. The boiler can be cleaned and maintained by simply disassembling the segments to provide access to the whole boiler.

1 Claim, 5 Drawing Sheets

SEGMENTED WATERTUBE BOILER SYSTEM

BACKGROUND

1. Field of the Invention

The present invention relates generally to steam systems, and more specifically, to a watertube boiler system.

2. Description of Related Art

Watertube boiler systems are well known in the art and are effective means to create steam. For example, FIG. 1 depicts a conventional watertube boiler system 101 having a heat source 103 and a steam drum 105 connected to a feedwater drum 107 by water tubes 109. During use, the heat source 103 causes water 111 in the feedwater drum 107 to heat and then exit the steam drum 105 via the water tubes.

One of the problems commonly associated with system 101 is its limited use. For example, the angular welding necessary to position water tube 109 to drums 105 and 107 does not facilitate easy maintenance. Additionally, the capacity of system 101 is fixed at manufacturer specifications and cannot be altered to accommodate changing requirements.

Accordingly, although great strides have been made in the area of watertube boiler systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
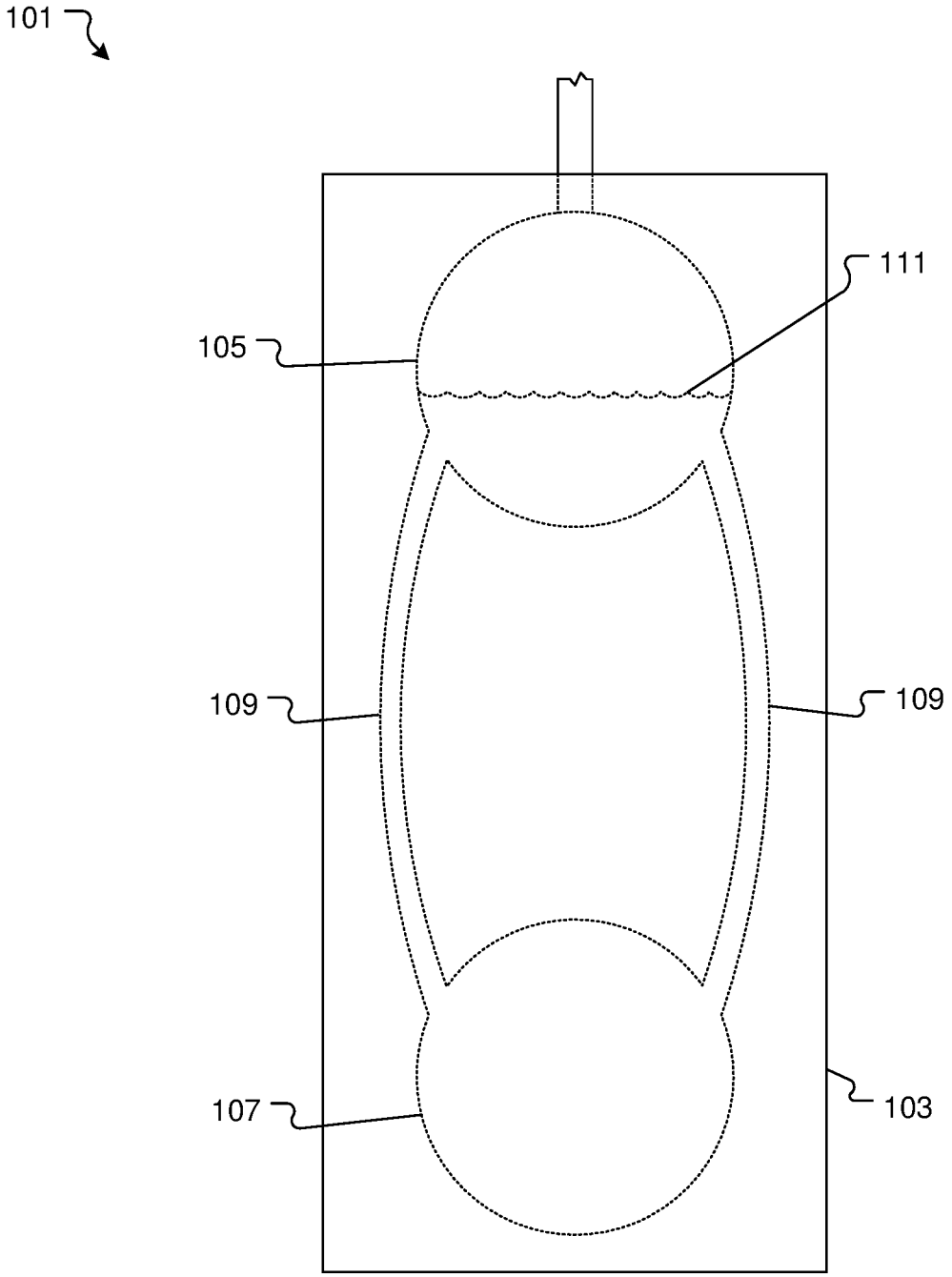
FIG. 1 (Prior Art)
FIG. 1 is a front view of a common watertube boiler system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional watertube boiler systems. Specifically, the system of the present application is constructed of segments that arrange the water tubes and drums so that they do not need to be physically joined. In addition, the segments are easily separated to facilitate both maintenance and alterations in system capacity. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
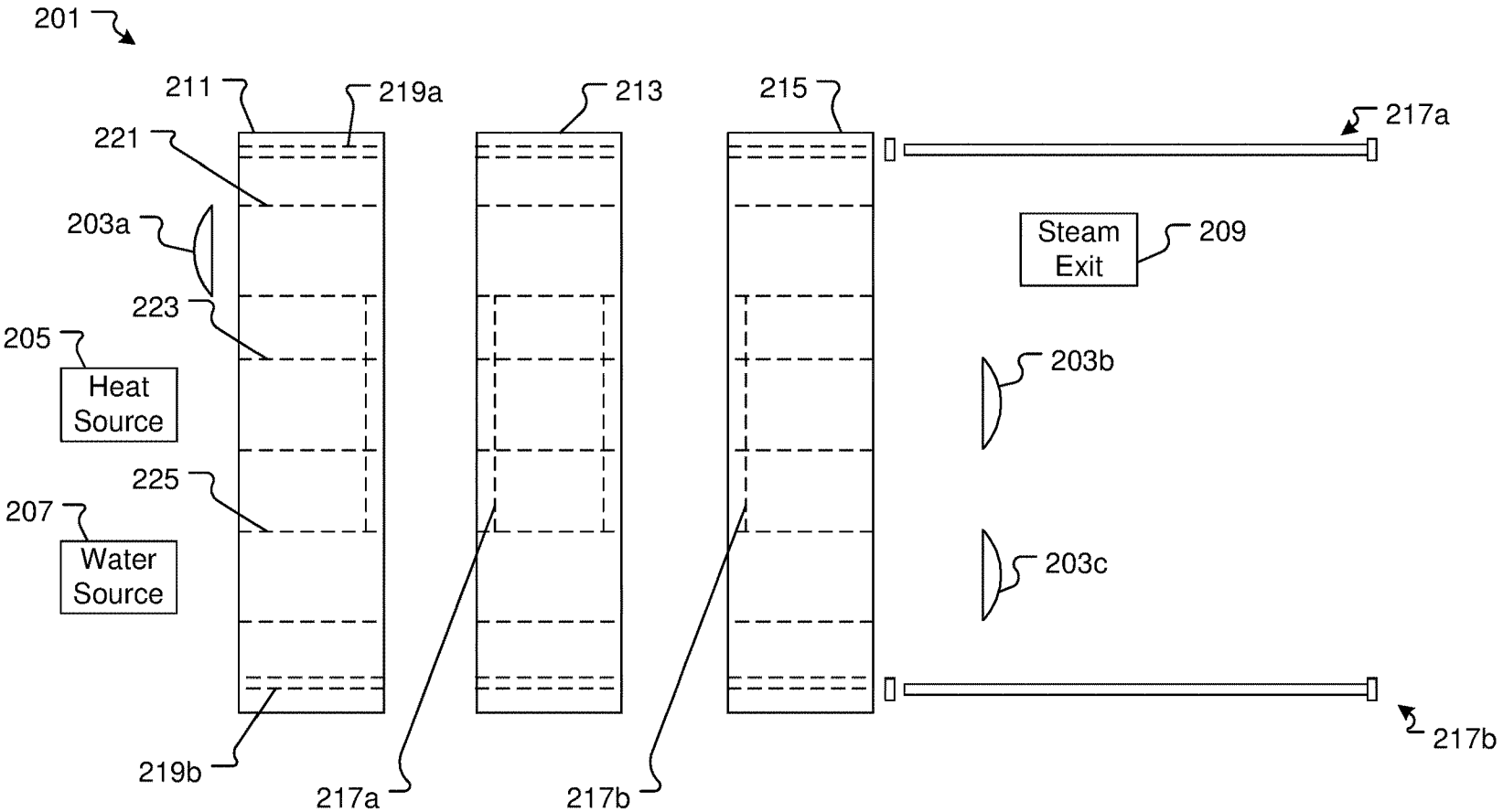
FIGS. 2A and 2B are an exploded side view and an assembled side view respectively of a segmented watertube boiler system in accordance with a preferred embodiment of the present application.
Figure 2B:
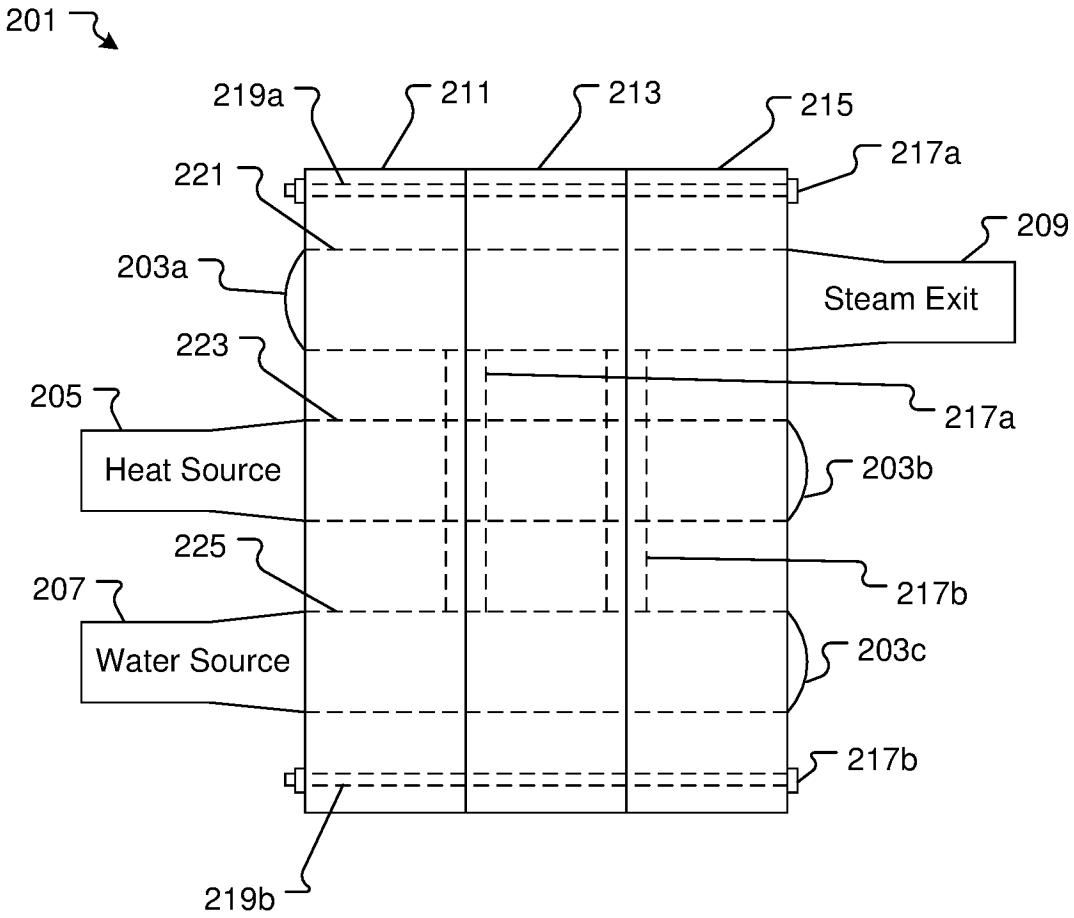

Referring now to the drawings wherein like reference characters identify corresponding or similar elements throughout the several views, FIGS. 2A and 2B depict an exploded side view and an assembled side view respectively of a segmented watertube boiler system in accordance with a preferred embodiment of the present application. It will be appreciated that system 201 overcomes one or more of the above-listed problems commonly associated with conventional watertube boiler systems.

In the contemplated embodiment, system 201 includes a first boiler segment 211 being attached to a second boiler segment 213 and a third boiler segment 215 via shafts and bolts 217. Where a heat source 205 and a water source 207 are attached to the first segment 211. A steam exit 209 is attached to the third segment 215. All other openings in the segments 211, 213, 215 are closed off by end caps 203.

In use segments 211, 213, 215 are arranged to create the desired boiler capacity by adding or removing segments. End caps 203 seal the open ends of segments 211, 213, 215. Heat 205 is then used to boil water 207 creating steam that leaves the system 201 via steam exit 209.

It should be appreciated that one of the unique features believed characteristic of the present application is segments 211, 213, 215 that facilitate construction, cleaning and expanding the capacity of system 201. It will also be appreciated that if one of the segments 211, 213, 215 fail the segment can be easily replaced.

Figure 3:
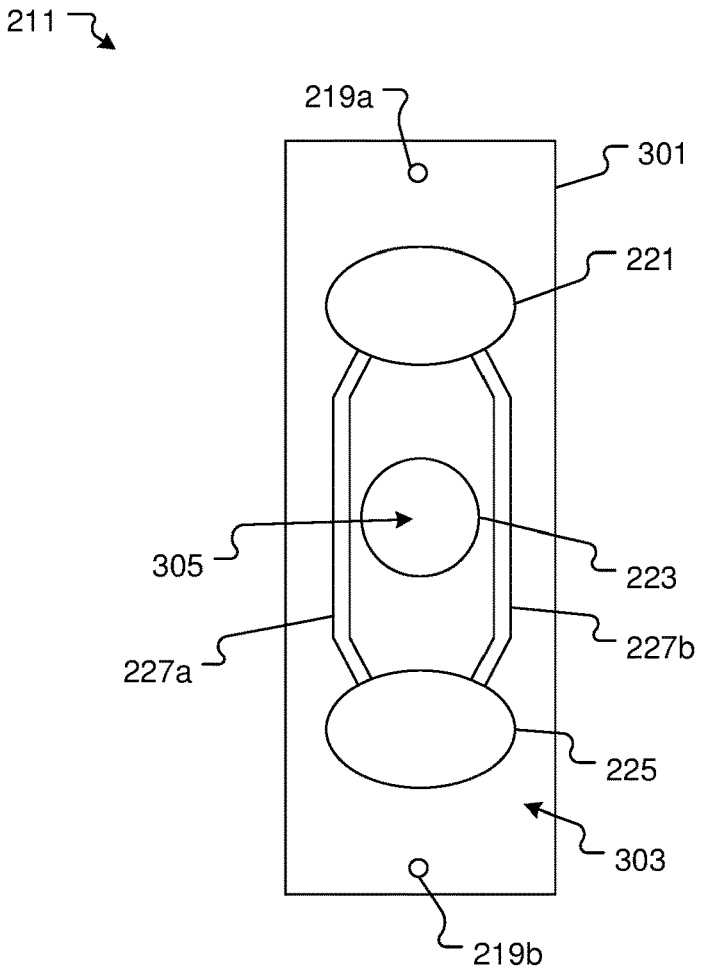
FIG. 3 is a front view of the first boiler segment of FIGS. 2A and 2B.

Referring now to FIG. 3 a front view of segment 211 is depicted, the segment 211 having a body 301 having an interior surface 303. The body 301 having penetrations 219 that allow the rods 217 to pass through. It will be understood that if some other means of binding the segments together is uses that the body 301 would not need or have the penetrations 219.

The body also having a penetration that serves as a hollow for receiving heat 223 that passes there through starting from the interior surface 303. The hollow for receiving heat 223 being generally located at the midpoint 305 of the body 301. Above and below the hollow for receiving heat 223 are penetrations that serve as hollows for receiving water 221, 225 passing through the body 301 starting from the interior surface 303.

The hollows for receiving water 221, 225 are connected via paths 227. The paths are cut out from the body 301 so that when two segments 211, 213, 215 are placed next to each other that the paths 227 in each segment form tubes through which water travels from one hollow 221, 225 to the other.

It will be appreciated that when boiler segments 211, 213, 215 are joined, hollows for receiving water 221, 225 create the steam drum 105 and feedwater drum 107 of system 101 and that paths 227 likewise create water tubes 109. While two paths 227 are depicted it is contemplated that any number of paths could be used. It will also be appreciated that the shape of the paths are shown as an example and it will be understood that any shaped path is contemplated. It is also believed that segments 211, 213, 215 better retain heat 205 increasing the efficiency of system 201 over the prior art.

It is contemplated and will be appreciated that sealant, seals or any like method of sealing could be used between segments 211, 213, 215 to ensure a complete seal with pressure applied via rods and bolts 217 and penetrations 219.

Figure 4:
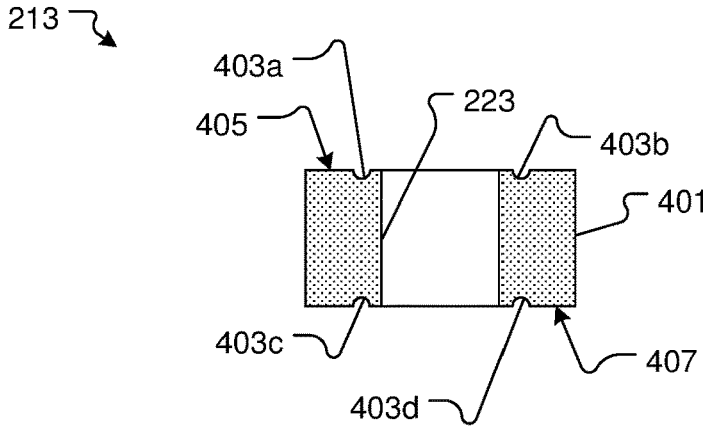
FIG. 4 is a cross-sectional top view of the second boiler segment of FIGS. 2A and 2B.

A cross-sectional top view of the second boiler segment 213 is depicted in FIG. 4. It will be understood that paths 403 are present on a first surface 405 and a second surface 407 of a body 401.

Another unique feature believed characteristic of the present application is that boiler segments 211, 213, 215 could be added or removed to quickly increase or decrease the capacity of the boiler. It is also contemplated that boiler segments 211, 213, 215 could be manufactured specifically to be on either end of the stack, and that the end caps 203 and source 205, 207 connections could be integrated in the respective sides 221.

Figure 5:
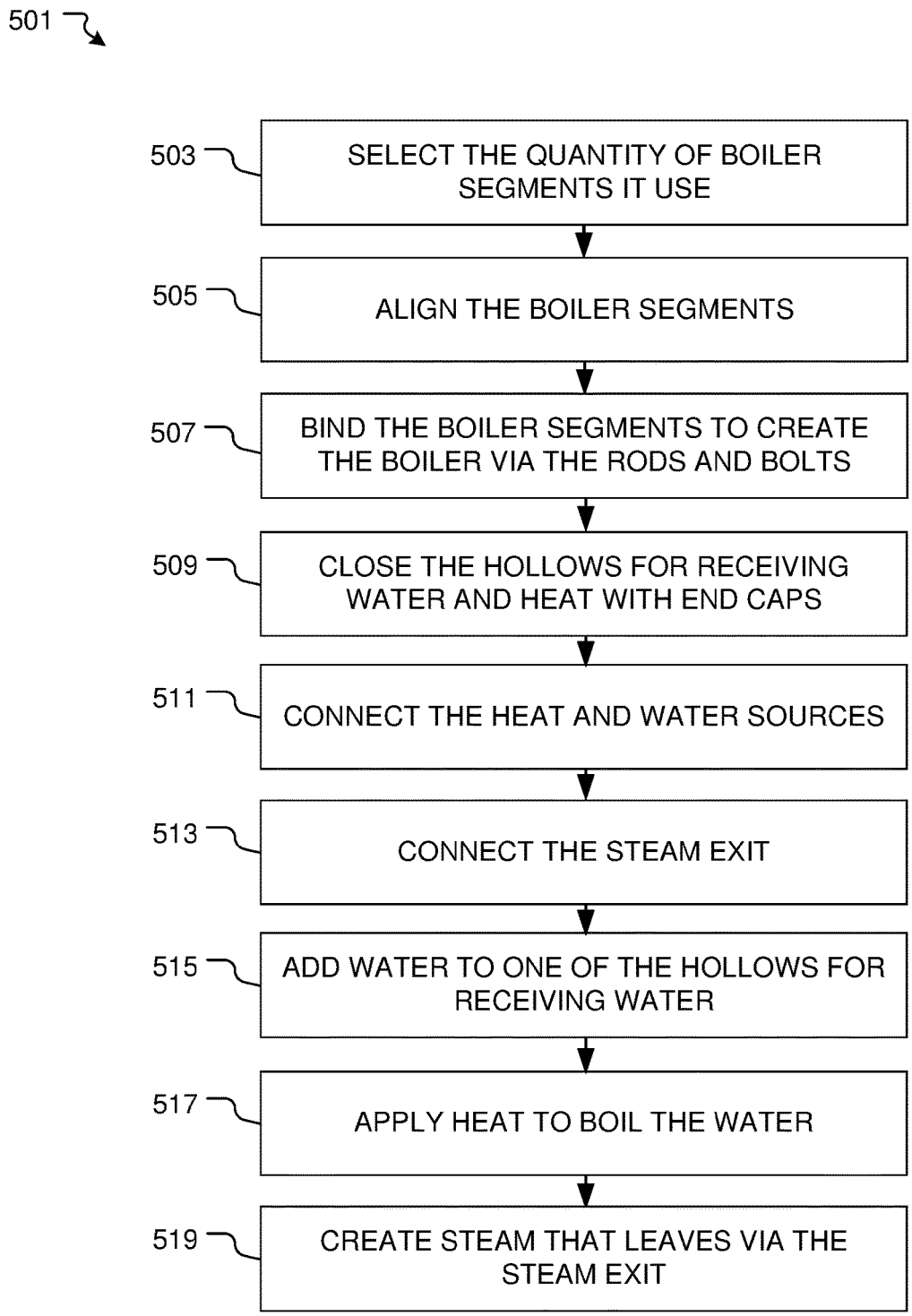
FIG. 5 is a flowchart of the preferred method of use of the system of FIGS. 2A and 2B.

Referring now to FIG. 5 the method of use of system 201 is depicted, the method 501 including selecting the quantity of boiler segments to use 503, aligning the boiler segments 505, binding the boiler segments to create the boiler via attachment means 507, closing the hollows for receiving heat and water with end caps 509, connecting the heat and water sources 511, connecting the steam exit 513, filling one of the hollows for receiving water 515, applying heat to boil the water 517 and creating steam that leaves via the steam exit 519.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A segmented watertube boiler system comprising:

at least two boiler segments joined together via an attachment means, a boiler segment of the at least two boiler segments having:

a body having:

an upper penetration; and a lower penetration;

wherein the upper penetration and the lower penetration extend through the body;

a first rod configured to extend through the upper penetration and is configured to secure the at least two boiler segments together;

a second rod configured to extend through the lower penetration and is configured to secure the at least two boiler segments together;

a first opening extending through the thickness of the body and configured to hold a water reservoir; and a second opening extending through the thickness of the body and configured to hold a heat source;

a third opening extending through the thickness of the body and configured to hold a steam reservoir;

wherein the second opening is positioned between the first opening and the third opening;

a first and second path in fluid communication with solely the first opening and the third opening and configured to travel on opposing sides of the second opening;

wherein the capacity of the system is adjusted by adding or removing segments from the system.

* * * * *